US010211585B2

(12) United States Patent
Robinault et al.

(10) Patent No.: US 10,211,585 B2
(45) Date of Patent: Feb. 19, 2019

(54) STARTER-GENERATOR BRUSH

(71) Applicant: Labinal Power Systems, Blagnac (FR)

(72) Inventors: Regan Scott Robinault, Twinsburg, OH (US); Donald Orville Kodger, Twinsburg, OH (US)

(73) Assignee: SAFRAN ELECTRICAL & POWER, Blagnac (FR)

( * ) Notice: Subject to any disclaimer, the term of this patent is extended or adjusted under 35 U.S.C. 154(b) by 328 days.

(21) Appl. No.: 15/058,208

(22) Filed: Mar. 2, 2016

(65) Prior Publication Data

US 2016/0276791 A1 Sep. 22, 2016

Related U.S. Application Data

(60) Provisional application No. 62/134,047, filed on Mar. 17, 2015.

(51) Int. Cl.

| | |
|---|---|
| ***H01R 39/26*** | (2006.01) |
| ***H01R 39/36*** | (2006.01) |
| *H01R 39/38* | (2006.01) |

(52) U.S. Cl.

CPC ..... *H01R 39/26* (2013.01); *H01R 39/36* (2013.01); *H01R 39/383* (2013.01)

(58) Field of Classification Search

CPC ..... H01R 39/26; H01R 39/36; H01R 39/383

USPC ..... 310/249

See application file for complete search history.

(56) References Cited

U.S. PATENT DOCUMENTS

| | | | | |
|---|---|---|---|---|
| 2,283,287 | A * | 5/1942 | Price | H01K 1/46 313/115 |
| 2,507,780 | A * | 5/1950 | Gilbert | H01R 43/12 228/139 |
| 4,739,209 | A * | 4/1988 | Sherman | H01R 39/383 310/249 |
| 6,246,145 | B1 * | 6/2001 | Morimoto | H01R 39/385 310/239 |
| 2009/0284097 | A1 * | 11/2009 | Kaneda | H01R 39/36 310/239 |

(Continued)

FOREIGN PATENT DOCUMENTS

| | | | |
|---|---|---|---|
| CN | 103855576 | 6/2014 | |
| DE | 4321475 | 1/1995 | |
| DE | 4321475 A1 * | 1/1995 | H01R 39/36 |

(Continued)

OTHER PUBLICATIONS

Auernhammer (DE 4321475 A1) English Translation.*

(Continued)

*Primary Examiner* — Quyen P Leung
*Assistant Examiner* — Robert E Mates
(74) *Attorney, Agent, or Firm* — Rankin, Hill & Clark LLP

(57) ABSTRACT

A brush for a starter-generator includes a first carbon block, a second carbon block, a terminal lug, and a plurality of brush leads. Each carbon block has an outboard edge and an inboard edge. Each carbon block includes a front carbon wafer and a rear carbon wafer. Front brush leads connect the terminal lug with the front carbon wafers of the respective carbon blocks adjacent the inboard edges of the respective carbon blocks. Rear brush leads connect the terminal lug with the rear carbon wafers of the respective carbon blocks adjacent the outboard edge of the respective carbon blocks.

19 Claims, 3 Drawing Sheets

(56) References Cited

U.S. PATENT DOCUMENTS

| | | | | |
|---|---|---|---|---|
| 2011/0177380 | A1* | 7/2011 | Langhoff | H01R 11/288<br>429/158 |
| 2014/0205135 | A1* | 7/2014 | Sakaguchi | H04R 9/027<br>381/415 |

FOREIGN PATENT DOCUMENTS

| | | | | |
|---|---|---|---|---|
| FR | 1035208 | | 8/1953 | |
| FR | 1035208 | A * | 8/1953 | H01R 39/24 |

OTHER PUBLICATIONS

FR 1035208 A English Translation.*
International Search Report dated Jul. 12, 2016, International Application No. PCT/US16/20321, five pages.

* cited by examiner

STARTER-GENERATOR BRUSH

BACKGROUND

Starter-generators include brushes having carbon blocks positioned in respective brush boxes. In known dual wafer brushes having two carbon blocks, the leads connecting the carbon wafers to a terminal lug attach to each front and rear wafer near an inboard side of each wafer. The carbon blocks are biased toward a commutator by a spring.

With these known starter-generator brushes, the brush leads are all located between the brush springs. As such, the leads can be bulky and rub on the brush box, which can result in the brush leads becoming frayed. Frayed brush leads can hang up on the brush box inhibiting movement of the carbon blocks in the brush boxes.

SUMMARY

In view of the foregoing, a brush for a starter-generator includes a first carbon block, a second carbon block, a terminal lug, a first front brush lead, a second front brush lead, a first rear brush lead, and a second rear brush lead. The first carbon block has an outboard edge and an inboard edge. The first carbon block includes a first front carbon wafer and a first rear carbon wafer contacting the first front carbon wafer. The second carbon block also has an outboard edge and an inboard edge. The inboard edge of the second carbon block faces and is adjacent to the inboard edge of the first carbon block. The second carbon block includes a second front carbon wafer and a second rear carbon wafer contacting the second front carbon wafer. The terminal lug includes a tab. The first front brush lead connects the terminal lug with the first front carbon wafer. The first front brush lead contacts the terminal lug at the tab and extends into the first front carbon wafer adjacent the inboard edge of the first front carbon wafer. The second front brush lead connects the terminal lug with the second front carbon wafer. The second front brush lead contacts the terminal lug at the tab and extends into the second front carbon wafer adjacent the inboard edge of the second front carbon wafer. The first rear brush lead connects the terminal lug with the first rear carbon wafer. The first rear brush lead contacts the terminal lug at the tab and extends into the first rear carbon wafer adjacent the outboard edge of the first rear carbon wafer. The second rear brush lead connects the terminal lug with the second rear carbon wafer. The second rear brush lead contacts the terminal lug at the tab and extends into the second rear carbon wafer adjacent the outboard edge of the second rear carbon wafer.

Another example of a brush for a starter-generator includes a left carbon block, a right carbon block, a terminal lug, a first inboard brush lead, a second inboard brush lead, a first outboard brush lead, and a second outboard brush lead. The left carbon block has an outboard edge and an inboard edge. The left carbon block includes a left first carbon wafer and a left second carbon wafer contacting the left first carbon wafer. The right carbon block also has an outboard edge and an inboard edge. The inboard edge of the right carbon block faces and is adjacent to the inboard edge of the left carbon block. The right carbon block includes a right first carbon wafer and a right second carbon wafer contacting the right first carbon wafer. The terminal lug includes a tab. The first inboard brush lead connects the terminal lug with the left first carbon wafer. The first inboard brush lead contacts the terminal lug at the tab and extends into the left first carbon wafer adjacent the inboard edge of the left carbon block. The second inboard brush lead connects the terminal lug with the right first carbon wafer. The second inboard brush lead contacts the terminal lug at the tab and extends into the right first carbon wafer adjacent the inboard edge of the right carbon block. The first outboard brush lead connects the terminal lug with the left second carbon wafer. The first outboard brush lead contacts the terminal lug at the tab and extends into the left second carbon wafer adjacent the outboard edge of the left carbon block. The second outboard brush lead connects the terminal lug with the right second carbon wafer. The second outboard brush lead contacts the terminal lug at the tab and extends into the right second carbon wafer adjacent the outboard edge of the right carbon block.

DETAILED DESCRIPTION

Figure 1:
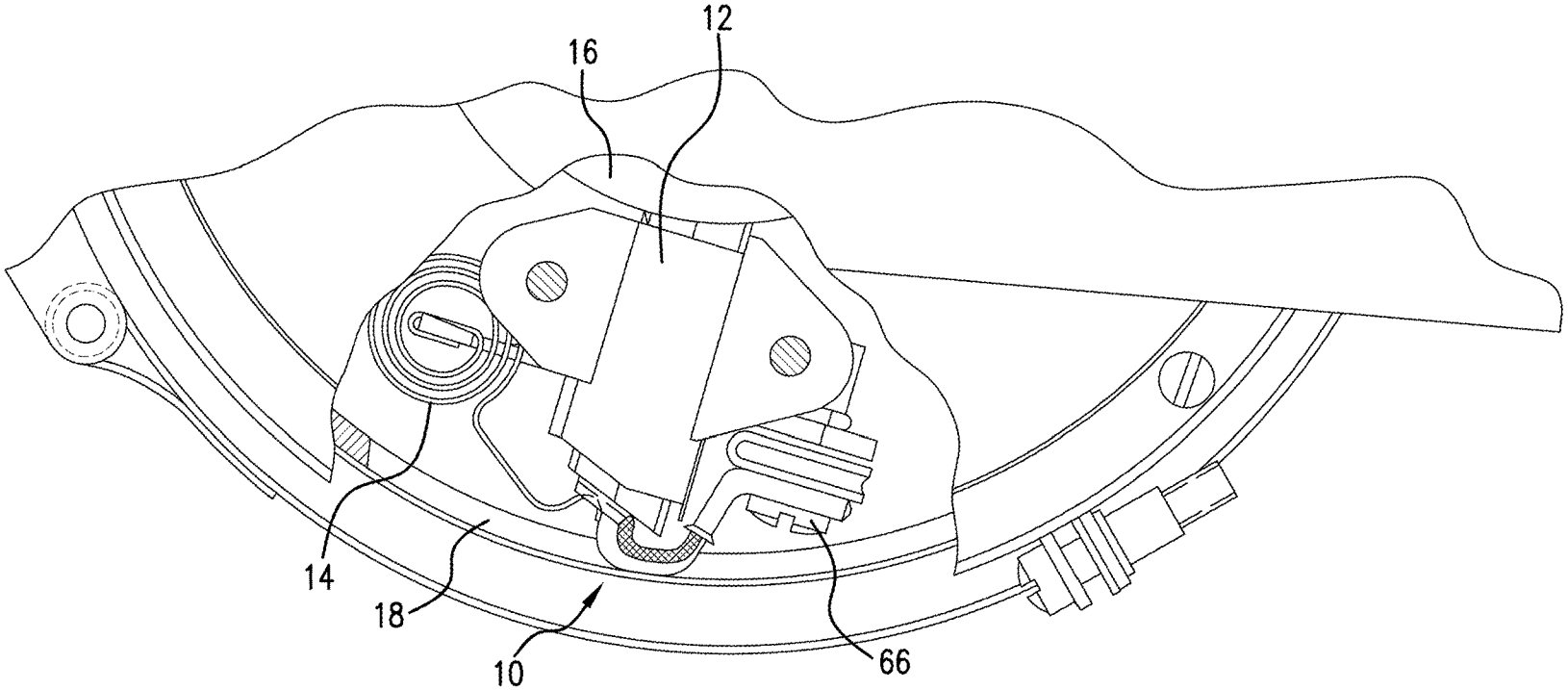
FIG. 1 is an end view of a portion of a starter-generator with a brush access cover partially broken away.

FIG. 1 depicts a brush 10 in a starter-generator (only a portion of which is shown in FIG. 1) and a brush box 12. A spring 14 biases the brush 12 toward a commutator 16 disposed within a housing 18.

Figure 2:
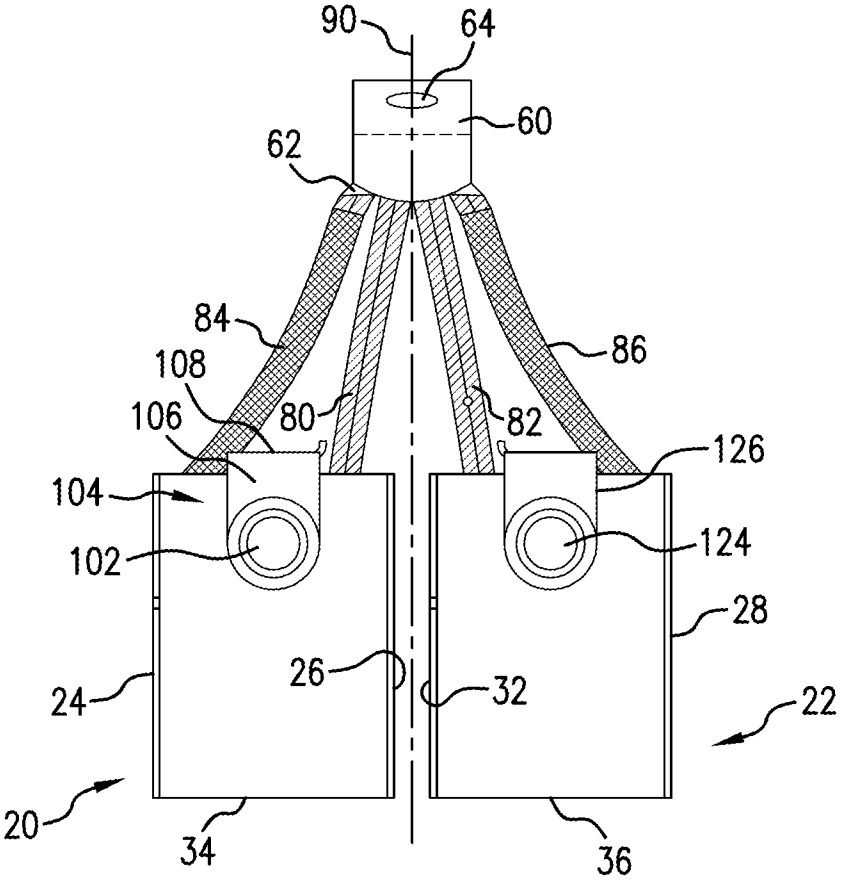
FIG. 2 is a rear view of a brush for the starter-generator.

With reference to FIG. 2, the brush 10 includes a first (left per the orientation shown in FIG. 2) carbon block 20 and a second (right per the orientation shown in FIG. 2) carbon block 22. The carbon blocks 20, 22 are positioned in the brush box 12 (FIG. 1) and can move within the brush box 12. The first carbon block 20 includes an outboard edge 24 and an inboard edge 26. The second carbon block 22 includes an outboard edge 28 and an inboard edge 32. The inboard edge 32 of the second carbon block 22 faces and is adjacent to the inboard edge 26 of the first carbon block 20. The first carbon block 20 also includes a lower edge 34. The second carbon block 22 also includes a lower edge 36. The lower edges 34, 36 of the respective carbon blocks 20, 22 each contact the commutator 16 (FIG. 1) when installed in the brush box 12 of the starter-generator.

Figure 4:
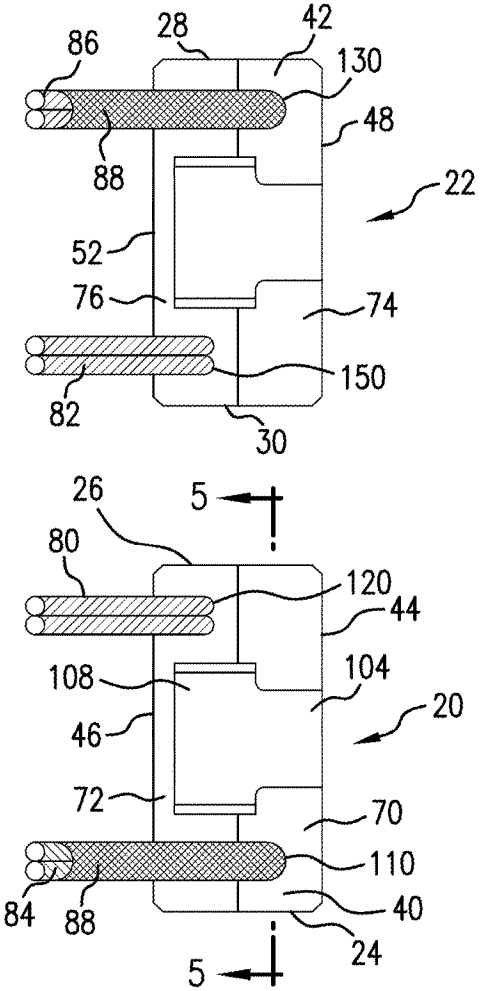
FIG. 4 is a top view of carbon blocks and brush leads for the brush depicted in FIG. 2.

With reference to FIG. 4, the first carbon block 20 includes a top surface 40 and the second carbon block 22 also includes a similar top surface 42. The top surfaces 40, 42 are spaced from the bottom surfaces 34, 36, respectively. The first carbon block 20 also includes a rear surface 44 and a front surface 46 that face away from one another. Similarly, the second carbon block 22 includes a rear surface 48 and a front surface 52 that face away from one another. In the illustrated embodiment, the vertical (per the orientation shown in FIG. 2) corners of each block 20, 22 are chamfered. Also, each block 20, 22 includes angled groove 54 (only the angled groove on the first block 20 is visible in the figures), which acts as a brush wear line, which represents the allowable brush wear.

Figure 3:
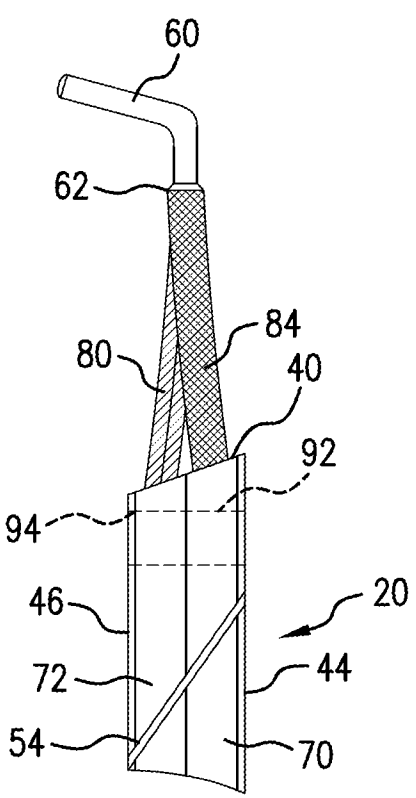
FIG. 3 is a side view of the brush depicted in FIG. 2.

With reference to FIGS. 2 and 3, the brush 10 also includes a terminal lug 60 having a tab 62. A fastener opening 64 extends through the terminal lug 60 and is configured to receive a fastener, e.g., a screw 66 (FIG. 1) to fix the terminal lug in the starter-generator.

The brush 10 includes a plurality of brush leads connecting a respective carbon block 20, 22 with the terminal lug 60. Each carbon block 20, 22 is a dual wafer design, and each brush lead connects a respective wafer with the terminal lug 60. With reference to FIG. 3, the first carbon block 20 includes a first front carbon wafer 72 and a first rear carbon wafer 70 contacting the first front carbon wafer 72. With reference to FIG. 4, the second carbon block 22 includes a second front carbon wafer 76 and a second rear carbon wafer 74 contacting the second front carbon wafer 76.

The plurality of brush leads includes a first front (inboard) brush lead 80 connecting the terminal lug 60 with the first front carbon wafer 72, a second front brush (inboard) lead 82 connecting the terminal lug 60 with the second front carbon wafer 76, a first rear (outboard) brush lead 84 connecting the terminal lug 60 with the first rear carbon wafer 70, and a second rear (outboard) brush lead 86 connecting the terminal lug 60 with the second rear carbon wafer 74. The first front brush lead 80 contacts the terminal lug 60 at the tab 62 and extends into the first front carbon wafer 72 adjacent the inboard edge 26 of the first carbon block 20. The second front brush lead 82 contacts the terminal lug 60 at the tab 62 and extends into the second front carbon wafer 76 adjacent the inboard edge 30 of the second carbon block 22. The first rear brush lead 84 contacts the terminal lug 60 at the tab 62 and extends into the first rear carbon wafer 70 adjacent the outboard edge 24 of the first carbon block 20. The second rear brush lead 86 contacts the terminal lug 60 at the tab 62 and extends into the second rear carbon wafer 74 adjacent the outboard edge 28 of the second carbon block 22.

In the illustrated embodiment, the first rear brush lead 84 and the second rear brush lead 86 are positioned outboard from the first front brush lead 80 and the second front brush lead 82 as seen in FIG. 2. Each of the brush leads 80, 82, 84 and 86 are made up of wires connecting the terminal lug 60 with the respective carbon wafers 72, 76, 70 and 74. In the illustrated embodiment, the first rear brush lead 84 and the second rear brush lead 86 are each insulated conductive wires, and the first front brush lead 80 and the second front brush lead 82 are uninsulated conductive wires. With the first rear brush lead 84 and the second rear brush lead 86 being nearer the respective outboard edges 24, 28 of the respective carbon blocks 20, 22 there is a greater likelihood for contact with the housing 18 (FIG. 1) and the insulation protects the wires making up the respective rear (outboard) brush leads 84, 86. Insulation 88 surrounding the first rear brush lead 84 extends to the first rear carbon wafer 70, and insulation 88 surrounding the second rear brush lead 86 extends to the second rear carbon wafer 74. As evident in FIG. 2, the first rear brush lead 84 is longer than the first front brush lead 80, and the second rear brush lead 86 is longer than the second front brush lead 82.

With reference back to FIG. 2, the brush 10 defines a mirror image line 90 equidistantly positioned between the inboard edge 26 of the first carbon block 20 and the inboard edge 32 of the second carbon block 22. The section of the brush 10 on one side of the mirror image line 90 is a mirror image of the section of the brush 10 on the opposite side of the mirror image line 90. Because of how the brush leads 80, 82, 84, 86 connect with the respective wafers 72, 76, 70, 74, the outboard brush leads 84, 86 can now be formed in the shape of a butterfly. With reference to FIG. 2, each brush lead 80, 82, 84 and 86 converges toward the mirror image line 90 moving along the respective brush lead from where each brush lead extends into the respective carbon wafer 72, 76, 70 and 74 toward the tab 62 of the terminal lug 60. In the orientation depicted in FIG. 2, each brush lead 80, 82, 84 and 86 converges toward the mirror image line 90 along the respective leads moving in an upward direction from the respective carbon blocks 20, 22 toward the terminal lug 60. By not having all brush leads 80, 82, 84, 86 connect along respective inboard edges 26, 30 of the respective carbon blocks 20, 22, the brush leads 80, 82, 84, 86 can be spread apart making them less bulky. Because the brush leads 80, 82, 84, 86 are less bulky, the outboard brush leads 84, 86 can be formed in the aforementioned butterfly shape. This inhibits the brush leads 80, 82, 84, 86 from rubbing against the brush box 12 (FIG. 1), subsequently preventing the brush leads 80, 82, 84, 86 from fraying. More particularly, the first rear brush lead 84 curves toward the mirror image line 90 moving along the first rear brush lead from the outboard edge 24 of the first carbon block 20 toward the tab 62 of the terminal lug 60. Similarly, the second rear brush lead 86 curves toward the mirror image line 90 moving along the second rear brush lead 86 from the outboard edge 28 of the second carbon block 22 toward the tab 62 of the terminal lug 60.

With reference to FIG. 3, the first carbon block 20 includes a first rear rivet opening 92 (shown in phantom in FIG. 3) extending through the first rear carbon wafer 70 and a first front rivet opening 94 extending through the first front carbon wafer 72. Each first rivet opening 92, 94 is equidistant between the inboard edge 26 and the outboard edge 24 of the first carbon block 20. A first rear rivet 102 is received in the first rear rivet opening 92. The first rear rivet 102 connects with a clip 104, which is L-shaped, by way of a non-soldered silver paste connection, for example. The clip 104 includes a rearward section 106 that extends along and is generally parallel with the rear surface 44 of the first carbon block 20 and a top section 108 that extends along and is generally parallel with the top surface 40 of the first front carbon wafer 72. Each of the rear carbon wafers 70, 74 has the upper surfaces 40, 42, which are not under the clips 104, machined perpendicular to the rear surface 44 and 48 respectively at the height of the upper surfaces of the respective front carbon wafers 72, 76 where the front and rear carbon wafers contact.

Figure 5:
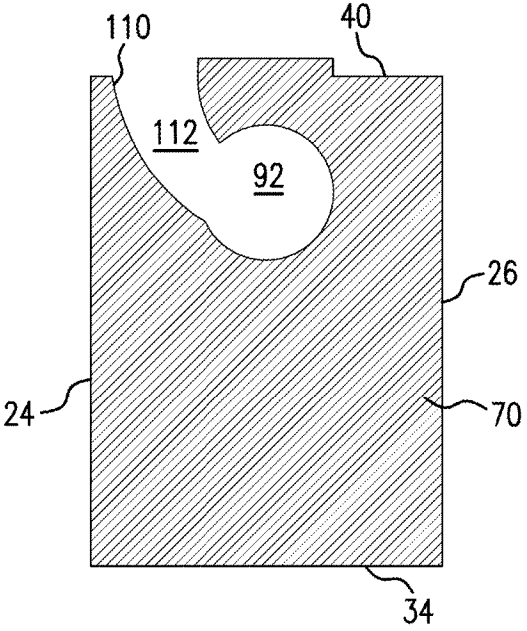
FIG. 5 is a cross-sectional view taken along line 5-5 of FIG. 4.

With reference to FIG. 5, the first rear carbon wafer 70 includes an outboard upper hole 110 adjacent the outboard edge 24. The outboard upper hole 110 opens to an outboard lead passage 112. The outboard lead passage 112 leads to the first rear rivet opening 92, which receives the first rear rivet 102 (FIG. 2). The first rear brush lead 84 is received through the outboard upper hole 110 and extends through the outboard lead passage 112 and electrically connects with the first rear rivet 102 (FIG. 2). The first carbon block 20 also includes an inboard upper hole 120 (FIG. 4) adjacent the inboard edge 26, which also opens to an inboard lead passage (not shown), which leads to the first front rivet opening 94. The first front brush lead 80 is received in the upper hole 120 in the first front carbon wafer 72 to connect with a first front rivet (not visible) that is similar to the first rear rivet 102. The outboard upper hole 110 is positioned on an outboard side of the clip 104 and the inboard upper hole 120 is positioned on an inboard side of the clip 104.

As indicated above, one side of the brush 10 with respect to the mirror image line 90 is mirror image of the other side. As such, the second carbon block 22 includes an outboard upper hole 130 adjacent the outboard edge 28 that opens to an outboard lead passage (not shown but similar in configuration to the outboard lead passage 112 shown in FIG. 4), which leads to a second rear rivet opening (not visible, but similar to the first rear rivet opening 92) which receives a second rear rivet 124. A clip 126 similar to the clip 106 is provided on the second block 22. The second rear brush lead 86 is received through the outboard upper hole 130 and extends through the outboard lead passage and electrically connects with the second rear rivet 124. An inboard upper hole 150 is provided in the second front carbon wafer 76 for receiving the second front brush lead 82 to connect the second front brush lead 82 with a second front rivet (not visible), which is received in a second front rivet opening (not visible). Each second rivet opening is equidistant between the inboard edge 30 and the outboard edge 28 of the second carbon block 22.

In the illustrated embodiment, each wafer 70, 72, 74 and 76 has only a single hole 110, 120, 130 and 150, respectively, for receiving a respective brush lead 80, 82, 84 and 86. Each rear carbon wafer 70, 74 includes a respective single outboard upper hole 110, 130 adjacent the outboard edge 24, 28 and each single outboard upper hole 110, 130 is open to a respective lead passage 112 (the lead passage connected with the outboard upper hole 130 is not shown, but is similar in configuration to the passage 112), which leads to a respective rear rivet opening 92, (not visible for the second block 22). With the orientation of the brush leads and the wafers described above, the brush leads 80, 82, 84, 86 are adequately spread out, which can be in the shape of a butterfly, so as to prevent the brush leads from rubbing against the brush box 12 and/or the housing 18 to inhibit fraying of the brush leads.

A brush for a starter-generator has been described above with particularity. Modifications and alterations will occur to those upon reading and understanding the preceding detailed description. For example, the outboard brush leads 84, 86 could connect with the front wafers 72, 76, respectively, and the inboard brush leads 80, 82 could connect with the rear wafers 70, 74, respectively. The invention, however, is not limited to only the embodiments described above. Instead, the invention is broadly defined by the appended claims and the equivalents thereof.

The invention claimed is:

1. A brush for a starter generator comprising:

a first carbon block having an outboard edge and an inboard edge, the first carbon block including a first front carbon wafer and a first rear carbon wafer contacting the first front carbon wafer;

a second carbon block having an outboard edge and an inboard edge, wherein the inboard edge of the second carbon block faces and is adjacent to the inboard edge of the first carbon block, the second carbon block including a second front carbon wafer and a second rear carbon wafer contacting the second front carbon wafer;

a terminal lug having a tab;

a first front brush lead connecting the terminal lug with the first front carbon wafer, wherein the first front brush lead contacts the terminal lug at the tab and the first front brush lead extends into the first front carbon wafer adjacent the inboard edge of the first carbon block;

a second front brush lead connecting the terminal lug with the second front carbon wafer, wherein the second front brush lead contacts the terminal lug at the tab and the second front brush lead extends into the second front carbon wafer adjacent the inboard edge of the second carbon block;

a first rear brush lead connecting the terminal lug with the first rear carbon wafer, wherein the first rear brush lead contacts the terminal lug at the tab and the first rear brush lead extends into the first rear carbon wafer adjacent the outboard edge of the first carbon block; and a second rear brush lead connecting the terminal lug with the second rear carbon wafer, wherein the second rear brush lead contacts the terminal lug at the tab and the second rear brush lead extends into the second rear carbon wafer adjacent the outboard edge of the second carbon block, wherein the brush defines a mirror image line positioned between the inboard edge of the first carbon block and the inboard edge of the second carbon block, and each of the brush leads converges toward the mirror image line along the respective brush lead moving from where the respective brush lead extends into the respective carbon wafer in the respective carbon block toward the tab of the terminal lug.

2. The brush of claim 1, wherein the first rear brush lead curves toward the mirror image line moving along the first rear brush lead from the outboard edge of the first carbon block toward the tab of the terminal lug, and the second rear brush lead curves toward the mirror image line moving along the second rear brush lead from the outboard edge of the second carbon block toward the tab of the terminal lug.

3. The brush of claim 1, wherein the first carbon block includes a first rear rivet opening extending through the first rear carbon wafer.

4. The brush of claim 3, further comprising a first rear rivet received in the first rear rivet opening.

5. The brush of claim 4, wherein the first rear carbon wafer includes an outboard upper hole adjacent the outboard edge of the first carbon block and open to a first lead passage, which leads to the first rear rivet opening.

6. The brush of claim 5, wherein the first rear brush lead is received through the outboard upper hole of the first carbon block and extends through the first lead passage and electrically connects with the first rear rivet.

7. The brush of claim 6, wherein the first rear rivet opening is equidistant between the inboard edge and the outboard edge of the first carbon block.

8. The brush of claim 1, wherein the first rear brush lead and the second rear brush lead are each insulated wires, and the first front brush lead and the second front brush lead are each uninsulated wires.

9. The brush of claim 8, wherein insulation surrounding the first rear brush lead extends to the first rear carbon wafer, and insulation surrounding the second rear brush lead extends to the second rear carbon wafer.

10. The brush of claim 1, wherein the first rear brush lead is longer than the first front brush lead, and the second rear brush lead is longer that the second front brush lead.

11. The brush of claim 1, wherein each wafer has only a single hole for receiving the respective brush lead.

12. The brush of claim 11, wherein each rear carbon wafer includes a respective single outboard upper hole adjacent the outboard edge of the respective rear carbon wafer, wherein each single outboard upper hole is open to a respective lead passage, which leads to a respective rivet opening extending through the respective rear carbon wafer between a front surface and a rear surface of the respective rear carbon wafer.

13. The brush of claim 12, wherein the respective rivet opening in the first carbon block receives a first rivet and the respective rivet opening in the second carbon block receives a second rivet, and the first rear brush lead electrically connects with the first rivet and the second rear brush lead electrically connects with the second rivet.

14. The brush of claim 13, wherein the respective rivet opening in the first carbon block is equidistant between the inboard edge and the outboard edge of the first carbon block, and the respective rivet opening in the second carbon block is equidistant between the inboard edge and the outboard edge of the second carbon block.

15. A brush for a starter-generator comprising:

a left carbon block having an outboard edge and an inboard edge, the left carbon block including a left first carbon wafer and a left second carbon wafer contacting the left first carbon wafer;

a right carbon block having an outboard edge and an inboard edge, wherein the inboard edge of the right carbon block faces and is adjacent to the inboard edge of the left carbon block, the right carbon block including a right first carbon wafer and a right second carbon wafer contacting the right first carbon wafer;

a terminal lug having a tab;

a first inboard brush lead connecting the terminal lug with the left first carbon wafer, wherein the first inboard brush lead contacts the terminal lug at the tab and extends into the left first carbon wafer adjacent the inboard edge of the left carbon block;

a second inboard brush lead connecting the terminal lug with the right first carbon wafer, wherein the second inboard brush lead contacts the terminal lug at the tab and extends into the right first carbon wafer adjacent the inboard edge of the right carbon block;

a first outboard brush lead connecting the terminal lug with the left second carbon wafer, wherein the first outboard brush lead contacts the terminal lug at the tab and extends into the left second carbon wafer adjacent the outboard edge of the left carbon block; and a second outboard brush lead connecting the terminal lug with the right second carbon wafer, wherein the second outboard brush lead contacts the terminal lug at the tab and extends into the right second carbon wafer adjacent the outboard edge of the right carbon block, wherein the brush defines a mirror image line positioned between the inboard edge of the left carbon block and the inboard edge of the right carbon block, and each of the brush leads converges toward the mirror image line along the respective brush lead moving from where the respective brush lead extends into the respective carbon wafer in the respective carbon block toward the tab of the terminal lug.

16. The brush of claim 15, wherein each of the wafers has only a single hole for receiving the respective brush lead.

17. The brush of claim 16, wherein each of the first carbon wafers is a front carbon wafer and each of the second carbon wafers is a rear carbon wafer.

18. The brush of claim 17, wherein each of the rear carbon wafers includes a respective single outboard upper hole adjacent the outboard edge of the respective rear carbon wafer, wherein each of the single outboard upper holes is open to a respective lead passage, which leads to a respective rear rivet opening extending through the respective rear carbon wafer between a front surface and a rear surface of the respective rear carbon wafer.

19. The brush of claim 18, wherein the respective rear rivet opening in the left carbon block receives a first rear rivet and the respective rear rivet opening in the right carbon block receives a second rear rivet, and the first outboard brush lead electrically connects with the first rear rivet and the second outboard brush lead electrically connects with the second rear rivet.

* * * * *